United States Patent [19]

Schweer et al.

[11] Patent Number: 4,469,557

[45] Date of Patent: Sep. 4, 1984

[54] PROCESS FOR CALCINING AND CARBONIZING PETROLEUM COKE

[75] Inventors: Chris V. Schweer, Brentwood; Jimmy B. Smith, Columbia, both of Tenn.

[73] Assignee: Peabody Development Company, St. Louis, Mo.

[21] Appl. No.: 467,393

[22] Filed: Feb. 17, 1983

[51] Int. Cl.[3] ..... C10B 39/06; C10B 41/00; C10B 49/06; C10B 57/02

[52] U.S. Cl. ..... 201/17; 201/25; 201/39

[58] Field of Search ..... 201/16, 17, 25, 29, 201/32, 34, 39, 44

[56] References Cited

U.S. PATENT DOCUMENTS

| | | | |
|---|---|---|---|
| 3,146,175 | 8/1964 | Mansfield | 201/34 |
| 3,167,487 | 1/1965 | Mansfield | 201/32 |
| 3,434,933 | 3/1969 | Mansfield | 201/32 |
| 3,470,275 | 9/1969 | Ban | 201/29 |
| 3,839,157 | 10/1974 | Hagstrom | 201/39 |
| 3,870,652 | 3/1975 | Whitten et al. | 201/32 |
| 4,100,034 | 7/1978 | Smith et al. | 201/39 |
| 4,156,595 | 5/1979 | Scott et al. | 201/32 |
| 4,276,120 | 6/1981 | Lutz | 201/32 |

*Primary Examiner*—Bradley Garris

*Attorney, Agent, or Firm*—Littlepage & Webner

[57] ABSTRACT

Green petroleum coke is partly devolatilized by transporting horizontally in static bed form through a furnace over a series of air box zones including a minority of zones adjacent the input end of the furnace and a majority remote from the input end and further devolatilized by soaking in a shaft furnace until at least most of the residual volatiles are driven off. From the shaft furnace the devolatilized coke is water quenched and steam produced in the quencher is mixed with downdrafted gases from said furnace to cool the same and prevent premature combustion.

1 Claim, 1 Drawing Figure

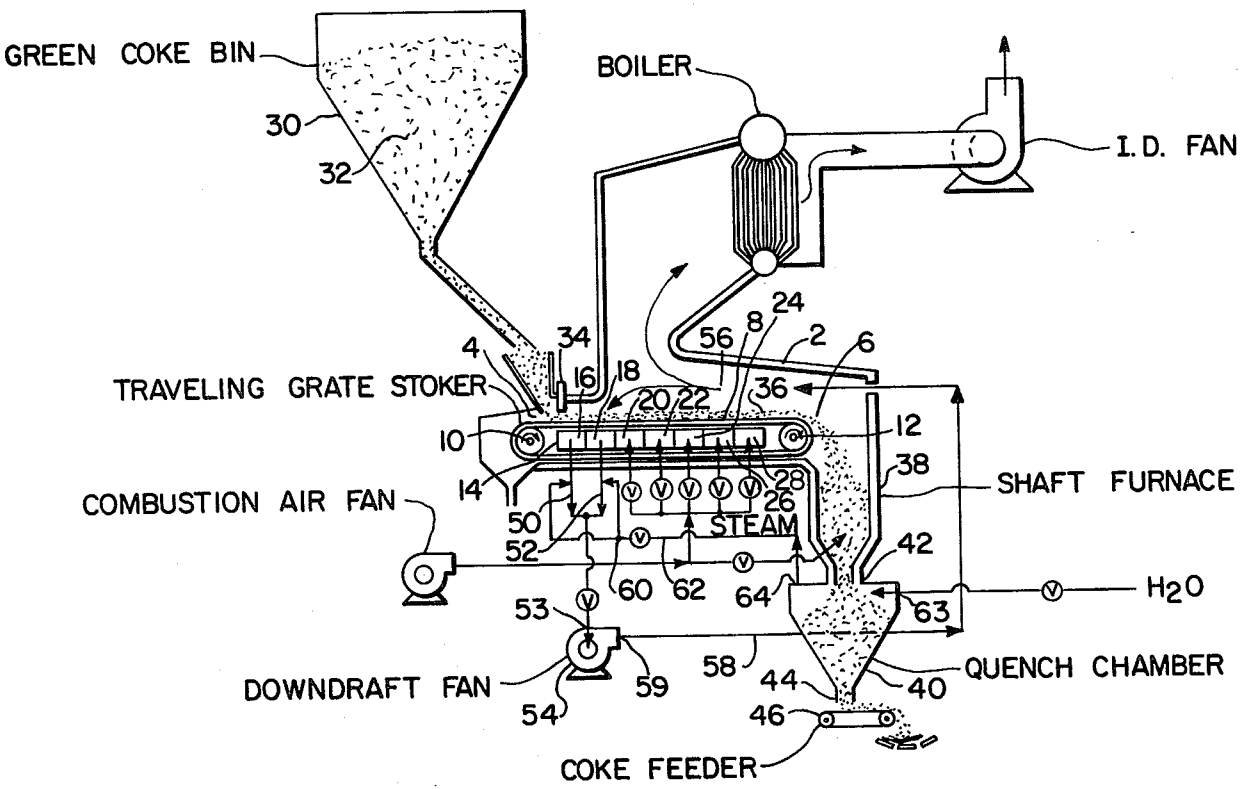
I.D. FAN
BOILER
GREEN COKE BIN
TRAVELING GRATE STOKER
SHAFT FURNACE
COMBUSTION AIR FAN
STEAM
$H_2O$
QUENCH CHAMBER
DOWNDRAFT FAN
COKE FEEDER
2
4
6
8
10
12
14
16
18
20
22
24
26
28
30
32
34
36
38
40
42
44
46
50
52
53
54
56
58
59
60
62
63
64

PROCESS FOR CALCINING AND CARBONIZING PETROLEUM COKE

FIELD OF INVENTION

Distillation processes, thermolytic, quenching char with inert material.

BACKGROUND OF THE INVENTION

The downdrafting of hot gases from the combustion chamber of a traveling chain grate coking furnace through a series of airbox zones is well-known, this being generally done as the coal passes over the initial airbox zones adjacent the input end of the furnace to drive off all mositure and low temperature volatiles from the coal. The downdrafted gases may be fed to a utilization device or back into the combustion chamber of the furnace. See, for example, Whitten and Hagstrom U.S. Pat. No. 3,870,652. The handling of the downdrafted gases presents certain problems in that they are hot and laden with volatile material and furnaces of this type are notoriously leaky. Hence, any air entering the stream of downdrafted gases either at the airbox zones or downstream in the gas line or in the downdraft fans is likely to cause premature combustion.

OBJECTS OF THE INVENTION

The object now is to preclude premature spontaneous combustion of downdrafted gases by utilizing steam output from a water cooled quench chamber for cooling the downdrafted gases upstream of a downdraft fan so that air entering the downdraft gas stream either through the fan or system leaks will not spontaneously combust with the downdrafted gases.

This, and other objects of the invention, will be apparent from the following specification and drawing, in which the sole FIGURE is a diagrammatic cross-section through the apparatus, illustrating the method.

A process for calcining and carbonizing coke is carried out in a horizontal chain grate furnace 2 having, laterally spaced, an input end 4 and an output end 6. A chain grate 8 is driven by sprockets 10, 12 which rotate as denoted by the curved arrows. An airbox 14 beneath chain grate 8 has a series of airbox zones 16, 18, 20, 22, 24, 26 and 28 extending serially from adjacent the input end to adjacent the output end, including a minority thereof adjacent input end 4 and a majority thereof remote from input end 4.

A hopper 30 contains starting material 32 which may be chosen from many carbonaceous materials including green petroleum coke, coal or other suitable material. The starting material 32 is spread, in static bed form, by spreader 34 into a bed 36 on chain grate 8 from which it is discharged, in coked condition, into shaft furnace 38. Water quencher 40, which is equipped with a water inlet 63 and steam outlet 64, admits material 32 from shaft furnace 38 through connection 42 between the bottom of shaft furnace 38 and the top of water quencher 40. Coke feeder 46 is used for withdrawing quenched coke in controlled amounts from the bottom of water quencher 40 through outlet 44.

An air feed 48 is used for feeding air in controlled amounts to the majority of the airbox zones remote from input end 4, and to the shaft furnace 38. Gas conduits 50, 52 are connected to the minority of airbox zones adjacent input end 4 in order to conduct downdrafting gases from the enclosed furnace atmosphere 56 through the bed of starting material, through the minority of airbox zones adjacent input end 4, through fan input 53 to fan 54. A conduit 58 leads the downdrafted gases from output 59 of fan 54 to furnace atmosphere 56 above the airbox zones.

A connection 60 in steam conduit 62 which leads from outlet 64 of water quencher 40 allows steam to be injected in controlled amounts into the stream of downdrafted gases, in this instance into the downdraft gas conduits 50, 52 upstream of fan 54.

The use of this process of mixing steam into the downdraft gases precludes spontaneous ignition and combustion of these gases.

We claim:

1. A process for calcining and carbonizing coke in a furnace having an enclosed furnace atmosphere and input and output laterally spaced ends, which comprises;

partly coking green carbonizable starting material by transporting a bed thereof horizontally in static bed form from the input to the output end of the furnace;

completing the coking of the material in a shaft furnace;

water-quenching the completely coked material while producing steam by-product;

wherein the furnace has a series of airbox zones beneath the bed extending serially from adjacent the input end to adjacent the output end thereof, including a minority of said airbox zones adjacent the input end of the furnace and a majority of said airbox zones remote from the input end;

feeding air in controlled amounts to said majority of airbox zones;

driving off moisture and low temperature volatiles from the green starting material by downdrafting a stream of hot gases from the furnace atmosphere through the starting material passing above the minority of airbox zones with a fan and fan-forcing the stream of downdrafted gases back into the furnace atmosphere wherein said stream passes through the starting material thence directly into and through said minority of airbox zones, thence directly into and through said fan, and thence directly into said furnace's atmosphere;

and cooling and rendering less spontaneously combustible the downdrafted gases by injecting steam by-product of the water-quenching into the stream of downdrafted gases downstream of the airbox zones with respect to stream flow and upstream of the fan.

* * * * *